US008020712B2

(12) United States Patent
Kopp et al.

(10) Patent No.: US 8,020,712 B2
(45) Date of Patent: Sep. 20, 2011

(54) DEVICE AND ASSOCIATED METHODS FOR STORING, DISPLAYING, AND SHAPING ITEMS

(76) Inventors: Kenneth B. Kopp, Greenville, SC (US); James T. Kopp, Sr., Easley, SC (US)

( * ) Notice: Subject to any disclaimer, the term of this patent is extended or adjusted under 35 U.S.C. 154(b) by 654 days.

(21) Appl. No.: 12/132,588

(22) Filed: Jun. 3, 2008

(65) Prior Publication Data

US 2009/0146036 A1 Jun. 11, 2009

Related U.S. Application Data

(63) Continuation-in-part of application No. 11/953,034, filed on Dec. 8, 2007.

(51) Int. Cl.
*A47F 7/06* (2006.01)

(52) U.S. Cl. ..... 211/30; 211/118

(58) Field of Classification Search ..... 211/85.3, 211/30, 113, 117, 118, 31; 223/12, 14, 85, 223/88, 89

See application file for complete search history.

(56) References Cited

U.S. PATENT DOCUMENTS

| | | | | | |
|---|---|---|---|---|---|
| 1,014,004 | A | * | 1/1912 | Irwin | 248/102 |
| 1,853,261 | A | * | 4/1932 | Dawson | 211/89.01 |
| 2,114,519 | A | * | 4/1938 | Beehler | 211/30 |
| 2,319,747 | A | * | 5/1943 | Osborne | 211/31 |
| 3,063,570 | A | * | 11/1962 | Kroner | 211/113 |
| 3,709,373 | A | * | 1/1973 | Aguilar | 211/113 |
| 4,195,739 | A | * | 4/1980 | Sweet, III | 211/113 |
| 4,519,564 | A | * | 5/1985 | Nadherny | 248/58 |
| 4,778,088 | A | * | 10/1988 | Miller | 223/91 |
| 4,927,063 | A | | 5/1990 | Fricano | |
| 5,092,472 | A | * | 3/1992 | Jones | 211/30 |
| 5,137,157 | A | | 8/1992 | Lawson | |
| 5,148,954 | A | | 9/1992 | Myers | |
| 5,244,102 | A | * | 9/1993 | Koenig | 211/32 |
| 5,630,516 | A | | 5/1997 | Helman | |
| 5,685,465 | A | | 11/1997 | Berardis | |
| 5,727,694 | A | | 3/1998 | Larson | |
| D393,970 | S | * | 5/1998 | Lee | D6/514 |
| 5,950,844 | A | * | 9/1999 | Taylor | 211/85.7 |
| 6,029,830 | A | * | 2/2000 | Manookian | 211/87.01 |
| 6,059,246 | A | * | 5/2000 | Robbins | 248/317 |
| 6,076,685 | A | * | 6/2000 | Ramirez | 211/13.1 |
| 6,158,593 | A | * | 12/2000 | Olsen | 211/14 |
| D441,174 | S | | 5/2001 | Farbenbloom | |
| 6,273,274 | B1 | * | 8/2001 | Lyles | 211/30 |
| 6,311,879 | B1 | | 11/2001 | Rigler et al. | |
| 6,422,400 | B1 | | 7/2002 | Miller | |
| 6,422,401 | B1 | | 7/2002 | Roten | |
| 6,814,418 | B2 | * | 11/2004 | D'Orso | 312/351 |
| 6,824,027 | B2 | | 11/2004 | Frey | |
| 6,840,411 | B2 | | 1/2005 | Fritz | |
| 7,097,080 | B2 | | 8/2006 | Cox | |
| 7,147,112 | B2 | * | 12/2006 | Penson | 211/30 |
| 7,789,250 | B2 | * | 9/2010 | Aamodt | 211/118 |
| 7,845,609 | B2 | * | 12/2010 | Bernard | 248/328 |
| 2006/0207952 | A1 | * | 9/2006 | Timmons | 211/85.3 |

* cited by examiner

*Primary Examiner* — Jennifer E. Novosad
(74) *Attorney, Agent, or Firm* — Crose Law LLC; Bradley D. Crose

(57) ABSTRACT

A device and associated methods for storing, displaying, and shaping apparel items, linens, and the like. The device includes a plurality of suspended bands, each suspended band being suspended vertically and having a front portion and a rear portion, the front portion and the rear portion being attached one to another at a plurality of predetermined connection points, thereby providing a plurality of loops in each suspended band, wherein the plurality of loops is configured to store, display, and shape a plurality of articles, each of the plurality of articles placed in one of the plurality of loops.

13 Claims, 3 Drawing Sheets

DEVICE AND ASSOCIATED METHODS FOR STORING, DISPLAYING, AND SHAPING ITEMS

CROSS-REFERENCE TO RELATED APPLICATION(S)

This present non-provisional patent application is a continuation-in-part of copending U.S. patent application Ser. No. 11/953,034, filed on Dec. 8, 2007, and entitled "DEVICE AND ASSOCIATED METHODS FOR STORING, DISPLAYING, AND SHAPING CAPS," and of which the application cited above is incorporated in-full by reference herein.

FIELD OF THE INVENTION

The technology described herein relates generally to devices and methods for storing, displaying, and shaping items such as hats, caps, shoes, clothing, clothing accessories, linens, and the like. More specifically, this technology relates to a device for storing and displaying a multiplicity of such items in a collapsible, multipurpose hanging system. In one exemplary embodiment, this technology relates to a device for simultaneously maintaining the curvature of the brim portion of a hat and training the brim of the hat to a particular degree of curvature as desired by the wearer and as selected in the device.

BACKGROUND OF THE INVENTION

Organizational devices can be useful for storage and display. Many storage and display devices are well known in the art. However, there are many deficiencies with these known devices. Many such devices do not hold a multiplicity of items while simultaneously providing for the display of each item and providing shape formation and shape maintenance to each item.

By way of example, hat storage and display devices are well known in the art. However, there are many deficiencies with these known hat storage and display devices. Many such devices do not hold a multiplicity of hats while simultaneously providing for the display of each hat and simultaneously providing brim maintenance to the curvature of the brim of each hat. Other known hat storage and display devices do not provide the means to train or maintain the curvature of the brim of each hat after initial training.

The following utility patents and design patents are known in the art. U.S. Pat. No. 6,840,411, issued to Fritz, discloses a storage and display device for baseball-type caps. U.S. Pat. No. 6,422,401, issued to Roten, discloses a hat storage and fashioning rack. U.S. Pat. No. 6,422,400, issued to Miller, discloses a brimmed cap storage and display device. U.S. Pat. No. 6,311,879, issued to Rigler et al., discloses a cap storage and bill shape maintenance device. U.S. Pat. No. 6,824,027, issued to Frey, discloses a cap brim shaper. U.S. Pat. No. 7,097,080, issued to Cox, discloses an athletic headwear shaping device. U.S. Pat. No. 5,244,102, issued to Koenig, discloses a cap receiving apparatus. U.S. Pat. No. 5,685,465, issued to Berardis, discloses a device for shaping the brim of a baseball cap. U.S. Pat. No. 5,727,694, issued to Larson, discloses a hat holder. U.S. Pat. No. 5,137,157, issued to Lawson, discloses a cap holder. U.S. Pat. No. 5,630,516, issued to Helman, discloses a ball cap display and storage rack assembly. U.S. Pat. No. D393,970, issued to Lee, discloses the ornamental design for a door-mounted cap-rack. U.S. Pat. No. 4,927,063, issued to Fricano, discloses a combination hat hanger and visor press. U.S. Pat. No. 5,148,954, issued to Myers, discloses an adjustable cap shaper. U.S. Pat. No. D441,174, issued to Farbenbloom, discloses the ornamental design for a hat shaper and sizer. U.S. Pat. No. 6,273,274, issued to Lyles, discloses a folded cap holder.

The foregoing patent information reflects the state of the art of which the inventors are aware and is tendered with a view toward discharging the inventors' acknowledged duty of candor in disclosing information that may be pertinent to the patentability of the technology described herein. It is respectfully stipulated, however, that the foregoing patents do not teach or render obvious, singly or when considered in combination, the inventors' claimed invention.

BRIEF SUMMARY OF THE INVENTION

In various exemplary embodiments, the technology described herein provides a device and associated methods for storing, displaying, and/or shaping apparel items, linens, and the like. Additionally, this technology provides a device for storing and displaying a multiplicity of hats while simultaneously maintaining the curvature of the brim portion of the hat. Furthermore, this technology provides a device for training the brim of a hat to a particular degree of curvature as desired by the wearer and as selected in the device. Other comparable uses are also contemplated herein, as will be apparent to those of ordinary skill in the art.

In one exemplary embodiment, the technology provides an article storage, display, and shaper device for simultaneously storing, displaying, and shaping a multiplicity of articles in a manner wherein each article is suspended. The device includes: a plurality of suspended bands, each suspended band being suspended vertically and having a front portion and a rear portion, the front portion and the rear portion being attached one to another at a plurality of predetermined connection points, thereby providing a plurality of loops in each suspended band, wherein the plurality of loops are configured to store, display, and shape a plurality of articles, each of the plurality of articles placed in one of the plurality of loops.

The article storage, display, and shaper device also includes an upper support rod, placed atop the article storage, display, and shaper device in a substantially horizontal manner, to provide for secure placement of the plurality of suspended bands, the plurality of suspended bands being connected to the upper support rod. The article storage, display, and shaper device also includes a hook, located in a substantially central manner on top of the upper support rod, and from which article storage, display, and shaper device is hung. The article storage, display, and shaper device further includes an a lower support rod placed at a bottom of the article storage, display, and shaper device in a substantially horizontal manner, to provide for secure placement of the plurality of suspended bands along the bottom, the plurality of suspended bands being connected to the lower support rod.

In various embodiments, the plurality of predetermined connection points is equally spaced along each of the plurality of suspended bands. In various embodiments, the plurality of predetermined connection points is variably spaced along each of the plurality of suspended bands to accommodate articles of varied sizes. In various embodiments, the plurality of predetermined connection points is integrally formed. In various embodiments, each of the plurality of suspended bands is comprised of a fabric material. In various embodiments, the plurality of predetermined connection points is formed by gluing, stitching, buckling, clamping, snapping, or fastening with hook-and-loop fasteners. In at least one embodiment, the plurality of articles comprises hangers and the plurality of suspended bands are configured to hold hangers, wherein each of the plurality of loops in each suspended band holds one or more hangers in a tiered manner to utilize the article storage, display, and shaper device as a space-saver device.

In another exemplary embodiment, the technology provides a method for simultaneously storing, displaying, and shaping a multiplicity of articles. The method includes: utilizing an article storage, display, and shaper device comprising a plurality of suspended bands, suspending each band vertically, each of the plurality of suspended bands having a front portion and a rear portion, attaching the front portion and the rear portion one to another at a plurality of predetermined connection points, thereby providing a plurality of loops in each suspended band, configuring the plurality of loops to store, display, and shape a plurality of articles; and placing any of the plurality of articles in one of the plurality of loops for storage, display, and/or shaping.

The method also includes utilizing an upper support rod, placed atop the article storage, display, and shaper device in a substantially horizontal manner, to provide for secure placement of the plurality of suspended bands, the plurality of suspended bands being connected to the upper support rod; utilizing a hook, located in a substantially central manner on top of the upper support rod, and from which article storage, display, and shaper device is hung; and utilizing a lower support rod placed at a bottom of the article storage, display, and shaper device in a substantially horizontal manner, to provide for secure placement of the plurality of suspended bands along the bottom, the plurality of suspended bands being connected to the lower support rod.

The method also includes attaching the plurality of suspended bands at a plurality of predetermined connection points by gluing. Alternatively, the method includes attaching the plurality of suspended bands at a plurality of predetermined connection points by stitching.

In yet another exemplary embodiment, the technology provides a cap storage, display, and shaper device for simultaneously storing, displaying, and shaping a multiplicity of caps in a manner wherein each cap is suspended by a brim of the cap. The device includes: a plurality of suspended bands, each suspended band being suspended vertically and having a front portion and a rear portion, the front portion and the rear portion being attached one to another at a plurality of predetermined connection points, thereby providing a plurality of loops in each suspended band, configured to receive a cap by a brim of the cap in a suspended manner and to maintain the degree of curvature of the brim of the cap, each of the plurality of caps placed in one of the plurality of loops.

The device also includes an upper support rod, placed atop the cap storage, display, and shaper device in a substantially horizontal manner, to provide for secure placement of the plurality of suspended bands, the plurality of suspended bands being connected to the upper support rod; and a hook, located in a substantially central manner on top of the upper support rod, and from which cap storage, display, and shaper device is hung.

The device further includes a lower support rod placed at a bottom of the cap storage, display, and shaper device in a substantially horizontal manner, to provide for secure placement of the plurality of suspended bands along the bottom, the plurality of suspended bands being connected to the lower support rod.

In various embodiments of the cap storage, display, and shaper device, a crown portion of each of a one or more caps stored in one of the plurality of loops in each suspended band is supported in the suspended manner of the cap, and is thus visible in display for selection. In various embodiments of the cap storage, display, and shaper device, a plurality of user options in the cap storage, display, and shaper device from wherein a user selects a degree of curvature desired for the brim of the cap based on the diameter of one of the plurality of loops in each suspended band. In various embodiments of the cap storage, display, and shaper device, the plurality of predetermined connection points are variably spaced along each of the plurality of suspended bands to accommodate articles of varied sizes.

Advantageously, this technology provides devices and methods for storing, displaying, and shaping items such as hats, caps, shoes, clothing, clothing accessories, linens, and the like. Additionally, this technology provides a device for storing and displaying a multiplicity of such items in a collapsible, multipurpose hanging system. Furthermore, in one embodiment, this technology advantageously provides a device for simultaneously maintaining the curvature of the brim portion of the hat and training the brim of a hat to a particular degree of curvature as desired by the wearer and as selected in the device.

There has thus been outlined, rather broadly, the features of this technology in order that the detailed description that follows may be better understood, and in order that the present contribution to the art may be better appreciated. There are additional features of the invention that will be described and which will form the subject matter of the claims. Additional aspects and advantages of this technology will be apparent from the following detailed description of an exemplary embodiment which is illustrated in the accompanying drawings. The technology described is capable of other embodiments and of being practiced and carried out in various ways. Also, it is to be understood that the phraseology and terminology employed are for the purpose of description and should not be regarded as limiting.

BRIEF DESCRIPTION OF THE DRAWINGS

The technology described herein is illustrated with reference to the various drawings, in which like reference numbers denote like system components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a device and associated methods for storing, displaying, and/or shaping apparel items, linens, and the like. Additionally, this technology provides a device for storing and displaying a multiplicity of hats while simultaneously maintaining the curvature of the brim portion of the hat. Furthermore, this technology provides a device for training the brim of a hat to a particular degree of curvature as desired by the wearer and as selected in the device. Other comparable uses are also contemplated herein, as will be apparent to those of ordinary skill in the art.

Figure 1:
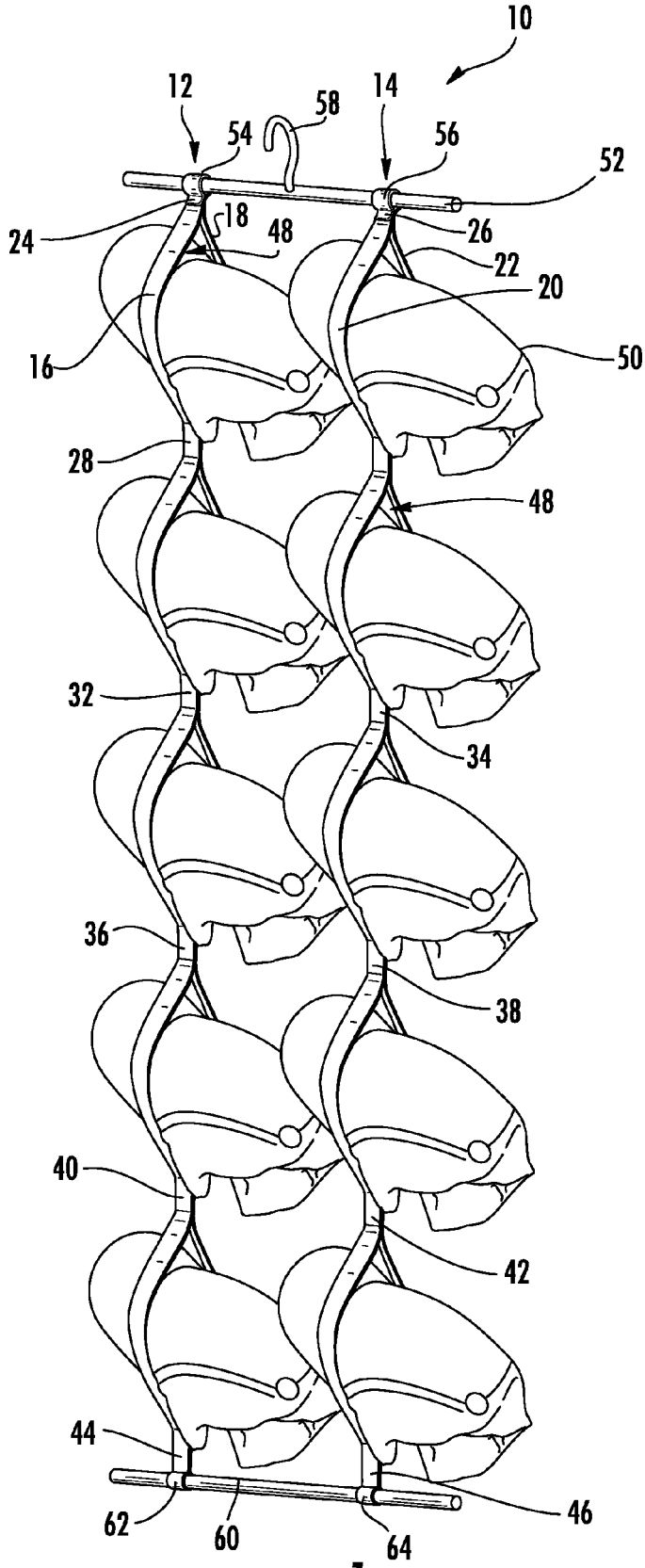
FIG. 1 is a front perspective view of a device for storing, displaying, and shaping items, according to one embodiment of the technology described herein, illustrating, in particular, a multiplicity of loops into which items are to be placed for storing and displaying, and into which items are to be placed for shaping and shape maintaining.
Figure 2:
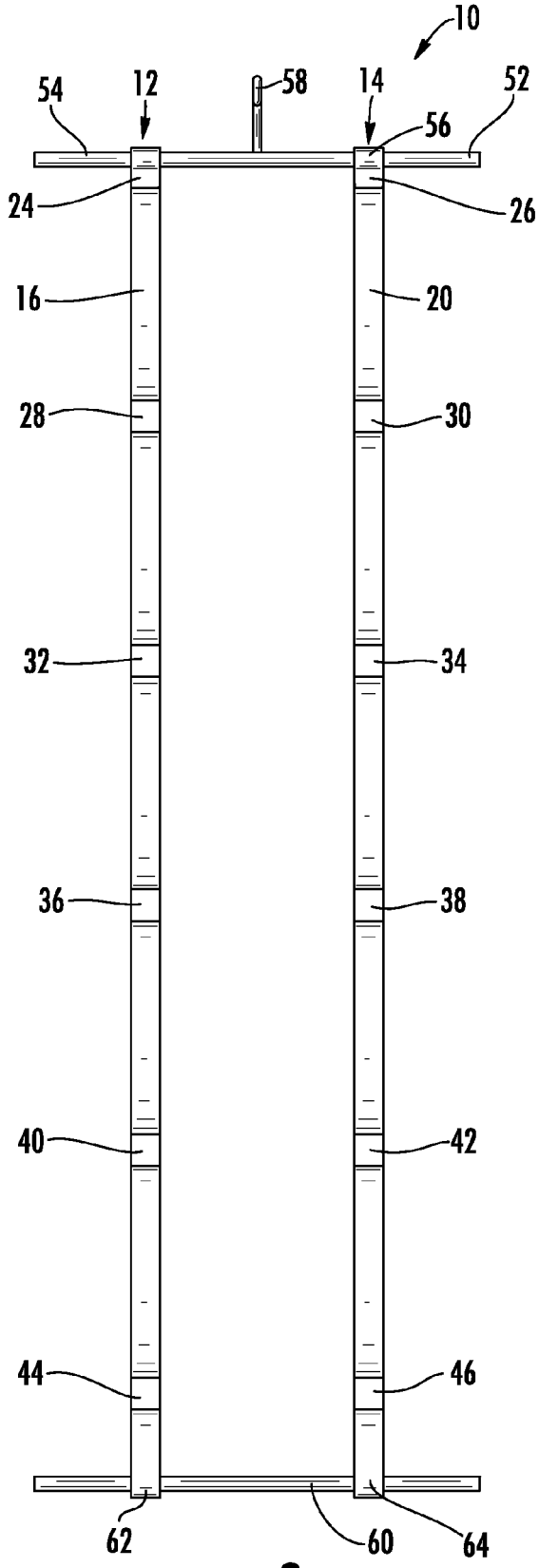
FIG. 2 is a front planar view of the device for storing, displaying, and shaping items of FIG. 1.
Figure 3:
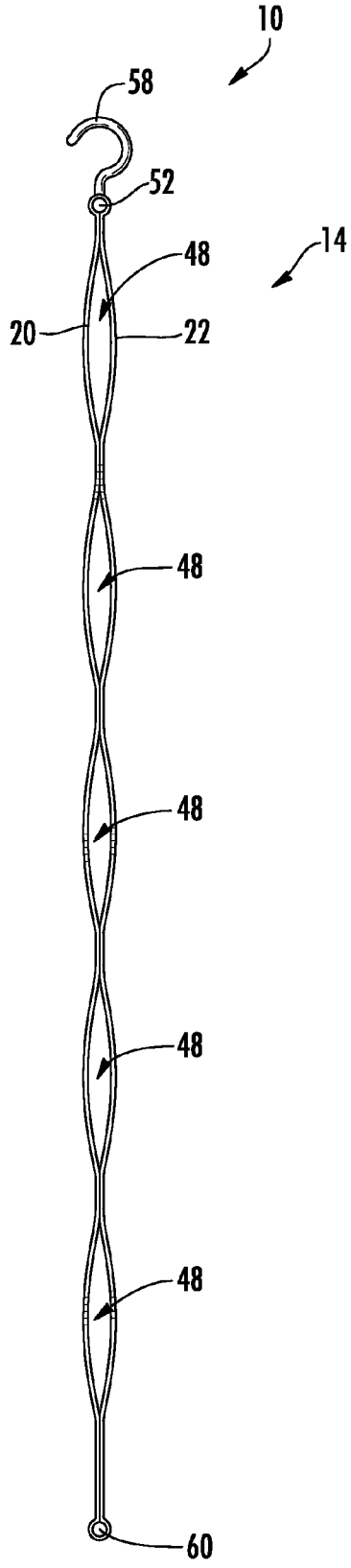
FIG. 3 is a side view of the device for storing, displaying, and shaping items of FIG. 2.

Referring now to FIGS. 1, 2, and 3, an article storing, displaying, and shaping device 10 is shown. The device 10 includes suspended bands 12, 14 that are suspended in a generally vertical manner. Two suspended bands 12, 14 are shown generally parallel to one another. The suspended bands 12, 14 can be made of a variety of flexible, compactable materials, including, but not limited to, a fabric material. One or many suspended bands 12, 14 can be utilized with the article storing, displaying, and shaping device 10. Each suspended band 12, 14 has a front portion 16, 20 and a rear portion 18, 22. The front portion 16, 20 and the rear portion 18, 22 of each suspended band 12, 14 are attached, for example, one to another at a multiplicity of predetermined connection points 24, 28, 32, 36, 40, 44 on suspended band 12 and 26, 30, 34, 38, 42, 46 on suspended band 14. By connecting the front portion 16, 20 and the rear portion 18, 22 of each suspended band 12, 14 one to another a multiplicity of loops 48 (best illustrated in the side view of FIG. 3) are provided in each suspended band 12, 14.

The multiplicity of loops 48 is configured to store, display, and shape a multiplicity of articles. Each of the articles (for example cap 50 in FIG. 1) is placed in one of the loops 48 in a suspended manner. Within the multiplicity of loops 48, apparel items, linens, and the like can be stored, displayed, and shaped. Apparel items include, for example, but not limited to, shoes, hats, caps, clothing, clothing accessories such as belts, ties, scarves, etc. Linen items include, for example, but not limited to, towels, washcloths, sheets, pillow covers, etc.

In at least one embodiment, the multiplicity of predetermined connection points 24, 28, 32, 36, 40, 44 on suspended band 12 and 26, 30, 34, 38, 42, 46 on suspended band 14 is equally spaced along each of the plurality of suspended bands 12, 14. In an alternative embodiment, the multiplicity of predetermined connection points 24, 28, 32, 36, 40, 44 on suspended band 12 and 26, 30, 34, 38, 42, 46 on suspended band 14 is variably spaced along each of the plurality of suspended bands 12, 14 to accommodate articles of varied sizes. This is accommodative of a device 10 used for storing caps 50 of various sizes, or for a mixed use device 10 that stores a variety of differing apparel items within the same device 10.

The multiplicity of predetermined connection points 24, 28, 32, 36, 40, 44 on suspended band 12 and 26, 30, 34, 38, 42, 46 on suspended band 14 can be joined in a variety of ways, including, but not limited to, integral formation, gluing, and stitching so long as the connection points remain firmly and securely attached. In alternative embodiments, the connection points are removably attached, for example, by buckles, clamps, snaps, hook-and-loop fasteners, or the like, thus providing a user with added flexibility and configurability.

In one embodiment the plurality of articles comprises hangers and the plurality of suspended bands are configured to hold hangers. Each of the plurality of loops in each suspended band holds one or more hangers in a tiered manner to utilize the article storage, display, and shaper device as a space-saver device. In this embodiment, apparel or linen items, or the like, can be hung first on one the hangers and then placed on the device 10. The tiered usage of the hangers creates a space-saver and enables the device 10 to hold a greater number of items.

The article storing, displaying, and shaping device 10 also includes an upper support rod 52. The upper support rod 52 is placed atop the article storage, display, and shaper device 10 in a substantially horizontal manner, to provide for secure placement of the suspended bands 12, 14. The suspended bands 12, 14 are connected, for example, to the upper support rod 52 at points 54, 56, respectively. The upper support rod 52 is comprised of a wood, plastic, metal, or like material to provide support to the article storing, displaying, and shaping device 10.

The article storing, displaying, and shaping device 10 also includes a hook 58, located, for example, in a substantially central manner on top of the upper support rod 52, and from which article storage, display, and shaper device 10 is hung. The hook 58 is comprised of wood, plastic, metal, fabric, or like material to provide a hanging means to the article storage, display, and shaper device 10. The device 10 is configured to suspend from a door, wall, ceiling or the like.

The article storing, displaying, and shaping device 10 also includes a lower support rod 60. The lower support rod 60 along the bottom of the article storing, displaying, and shaping device 10 in a substantially horizontal manner, to provide for secure placement of the plurality of suspended bands 12, 14 along the bottom. The suspended bands 12, 14 are connected to the lower support rod 60 at points 62, 64. The lower support rod 60 is comprised of wood, plastic, metal, or like material to provide support to the article storing, displaying, and shaping device 10.

A method for simultaneously storing, displaying, and shaping a multiplicity of articles is provided. The method includes: utilizing an article storage, display, and shaper device 10 comprising a plurality of suspended bands 12, 14, suspending each band 12, 14 vertically, each of the plurality of suspended bands 12, 14 having a front portion 16, 20 and a rear portion 18, 22, attaching the front portion 16, 20 and the rear portion 18, 22 one to another at a plurality of predetermined connection points 24, 28, 32, 36, 40, 44 on suspended band 12 and 26, 30, 34, 38, 42, 46 on suspended band 14, thereby providing a plurality of loops 48 in each suspended band 12, 14, configuring the plurality of loops 48 to store, display, and shape a plurality of articles 50, for example, and placing any of the plurality of articles 50 in one of the plurality of loops 48 for storage, display, and/or shaping.

The method also includes utilizing an upper support rod 52, placed atop the article storage, display, and shaper device 10 in a substantially horizontal manner, to provide for secure placement of the plurality of suspended bands 12, 14, the plurality of suspended bands 12, 14 being connected to the upper support rod 52; utilizing a hook 58, located in a substantially central manner on top of the upper support rod 52, and from which article storage, display, and shaper device 10 is hung; and utilizing a lower support rod 60 placed at a bottom of the article storage, display, and shaper device 10 in a substantially horizontal manner, to provide for secure placement of the plurality of suspended bands 12, 14 along the bottom, the plurality of suspended bands 12, 14 being connected to the lower support rod 60 at points 62, 64.

The method also includes attaching the plurality of suspended bands 12, 14 at a plurality of predetermined connection points by gluing. Alternatively, the method includes attaching the plurality of suspended bands 12, 14 at a plurality of predetermined connection points by stitching.

In one embodiment, a cap storage, display, and shaper device 10 for simultaneously storing, displaying, and shaping a multiplicity of caps 50 in a manner wherein each cap is suspended by a brim of the cap. The device 10 includes: a plurality of suspended bands 12, 14, each suspended band 12, 14 being suspended vertically and having a front portion 16, 20 and a rear portion 18, 22, the front portion 16, 20 and the rear portion 18, 22 being attached one to another at a plurality of predetermined connection points 24, 28, 32, 36, 40, 44 on suspended band 12 and 26, 30, 34, 38, 42, 46 on suspended band 14, thereby providing a plurality of loops 48 in each suspended band 12, 14, configured to receive a cap 50 by a brim of the cap in a suspended manner and to maintain the degree of curvature of the brim of the cap 50, each of the plurality of caps placed in one of the plurality of loops 48.

The device 10 also includes an upper support rod 52, placed atop the cap storage, display, and shaper device 10 in a substantially horizontal manner, to provide for secure placement of the plurality of suspended bands 12, 14, the plurality of suspended bands 12, 14 being connected to the upper support rod 52; and a hook 58, located in a substantially central manner on top of the upper support rod 52, and from which cap storage, display, and shaper device 10 is hung.

The device 10 further includes a lower support rod 60 placed at a bottom of the cap storage, display, and shaper device 10 in a substantially horizontal manner, to provide for secure placement of the plurality of suspended bands 12, 14 along the bottom, the plurality of suspended bands 12, 14 being connected to the lower support rod 60 at points 62, 64.

In various embodiments of the cap storage, display, and shaper device 10, a crown portion of each of a one or more caps 50 stored in one of the plurality of loops 48 in each suspended band 12, 14 is supported in the suspended manner of the cap, and is thus visible in display for selection. In various embodiments of the cap storage, display, and shaper device 10, a plurality of user options in the cap storage, display, and shaper device 10 from wherein a user selects a degree of curvature desired for the brim of the cap 50 based on the diameter of one of the plurality of loops 48 in each suspended band 12, 14. In various embodiments of the cap storage, display, and shaper device 10, the plurality of predetermined connection points 24, 28, 32, 36, 40, 44 on suspended band 12 and 26, 30, 34, 38, 42, 46 on suspended band 14, are variably spaced along each of the plurality of suspended bands 12, 14 to accommodate articles of varied sizes.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. An article storage, display, and shaper device for simultaneously storing, displaying, and shaping a multiplicity of articles in a manner wherein each article is suspended, the device comprising:

a plurality of suspended bands, each suspended band being flat and generally parallel to one another and suspended vertically and having a front portion and a rear portion, the front portion and the rear portion being attached one to another at a plurality of predetermined connection points, thereby providing a plurality of loops in each suspended band, wherein the plurality of loops is configured to store, display, and shape a plurality of articles, each of the plurality of articles placed in one of the plurality of loops;

an upper support rod, placed atop the article storage, display, and shaper device in a substantially horizontal manner, to provide for secure placement of the plurality of suspended bands, the plurality of suspended bands being connected to the upper support rod;

a hook, located in a substantially central manner on top of the upper support rod, and from which article storage, display, and shaper device is hung; and a lower support rod placed at a bottom of the article storage, display, and shaper device in a substantially horizontal manner, to provide for secure placement of the plurality of suspended bands along the bottom, the plurality of suspended bands being connected to the lower support rod.

2. The article storage, display, and shaper device of claim 1, wherein the plurality of predetermined connection points is equally spaced along each of the plurality of suspended bands.

3. The article storage, display, and shaper device of claim 1, wherein the plurality of predetermined connection points is integrally formed.

4. The article storage, display, and shaper device of claim 1, wherein each of the plurality of suspended bands is comprised of a fabric material.

5. The article storage, display, and shaper device of claim 1, wherein the plurality of predetermined connection points is formed by one of: gluing, stitching, buckling, clamping, snapping, and fastening with hook-and-loop fasteners.

6. The article storage, display, and shaper device of claim 1, wherein the plurality of suspended bands are configured to hold hangers, wherein each of the plurality of loops in each suspended band holds one or more hangers in a tiered manner to utilize the article storage, display, and shaper device as a space-saver device.

7. A method for simultaneously storing, displaying, and shaping a multiplicity of articles, the method comprising:

utilizing an article storage, display, and shaper device comprising a plurality of suspended bands each suspended band being flat and generally parallel to one another and, suspending each band vertically, each of the plurality of suspended bands having a front portion and a rear portion, attaching the front portion and the rear portion one to another at a plurality of predetermined connection points, thereby providing a plurality of loops in each suspended band, configuring the plurality of loops to store, display, and shape a plurality of articles;

utilizing an upper support rod, placed atop the article storage, display, and shaper device in a substantially horizontal manner, to provide for secure placement of the plurality of suspended bands, the plurality of suspended bands being connected to the upper support rod;

utilizing a hook, located in a substantially central manner on top of the upper support rod, and from which article storage, display, and shaper device is hung;

utilizing a lower support rod placed at a bottom of the article storage, display, and shaper device in a substantially horizontal manner, to provide for secure placement of the plurality of suspended bands along the bottom, the plurality of suspended bands being connected to the lower support rod; and placing any of the plurality of articles in one of the plurality of loops for storage, display, and/or shaping.

8. The method for simultaneously storing, displaying, and shaping a multiplicity of articles of claim 7, further comprising:

utilizing an upper support rod, placed atop the article storage, display, and shaper device in a substantially horizontal manner, to provide for secure placement of the plurality of suspended bands, the plurality of suspended bands being connected to the upper support rod;

utilizing a hook, located in a substantially central manner on top of the upper support rod, and from which article storage, display, and shaper device is hung; and utilizing a lower support rod placed at a bottom of the article storage, display, and shaper device in a substantially horizontal manner, to provide for secure placement of the plurality of suspended bands along the bottom, the plurality of suspended bands being connected to the lower support rod.

9. The method for simultaneously storing, displaying, and shaping a multiplicity of articles of claim 7, further comprising:

attaching the plurality of suspended bands at a plurality of predetermined connection points by gluing.

10. The method for simultaneously storing, displaying, and shaping a multiplicity of articles of claim 7, further comprising:

attaching the plurality of suspended bands at a plurality of predetermined connection points by stitching.

11. A cap storage, display, and shaper device for simultaneously storing, displaying, and shaping a multiplicity of caps in a manner wherein each cap is suspended by a brim of the cap, the device comprising:

a plurality of suspended bands, each suspended band being flat and generally parallel to one another and being suspended vertically and having a front portion and a rear portion, the front portion and the rear portion being attached one to another at a plurality of predetermined connection points, thereby providing a plurality of loops in each suspended band, configured to receive a cap by a brim of the cap in a suspended manner and to maintain the degree of curvature of the brim of the cap, each of the plurality of caps placed in one of the plurality of loops;

an upper support rod, placed atop the article storage, display, and shaper device in a substantially horizontal manner, to provide for secure placement of the plurality of suspended bands, the plurality of suspended bands being connected to the upper support rod;

a hook, located in a substantially central manner on top of the upper support rod, and from which article storage, display, and shaper device is hung; and a lower support rod placed at a bottom of the article storage, display, and shaper device in a substantially horizontal manner, to provide for secure placement of the plurality of suspended bands along the bottom, the plurality of suspended bands being connected to the lower support rod.

12. The cap storage, display, and shaper device for simultaneously storing, displaying, and shaping a multiplicity of caps in a manner wherein each cap is suspended by a brim of the cap of claim 11, further comprising:

an upper support rod, placed atop the cap storage, display, and shaper device in a substantially horizontal manner, to provide for secure placement of the plurality of suspended bands, the plurality of suspended bands being connected to the upper support rod; and a hook, located in a substantially central manner on top of the upper support rod, and from which cap storage, display, and shaper device is hung.

13. The cap storage, display, and shaper device for simultaneously storing, displaying, and shaping a multiplicity of caps in a manner wherein each cap is suspended by a brim of the cap of claim 11, further comprising:

a lower support rod placed at a bottom of the cap storage, display, and shaper device in a substantially horizontal manner, to provide for secure placement of the plurality of suspended bands along the bottom, the plurality of suspended bands being connected to the lower support rod.

* * * * *